US006331133B1

(12) United States Patent
Katayama et al.

(10) Patent No.: US 6,331,133 B1
(45) Date of Patent: Dec. 18, 2001

(54) AUTOMATIC DRILL BIT RE-POINTING APPARATUS AND METHOD

(75) Inventors: Ichiro Katayama, Tokyo; Yoshinobu Watanabe, Nagaoka; Yuichi Nakajima, Nagaoka; Yoshiharu Shinbo, Nagaoka, all of (JP)

(73) Assignee: Union Tool Company, Tokyo (JP)

( * ) Notice: Subject to any disclaimer, the term of this patent is extended or adjusted under 35 U.S.C. 154(b) by 0 days.

(21) Appl. No.: 09/166,767

(22) Filed: Oct. 5, 1998

(30) Foreign Application Priority Data

Oct. 6, 1997 (JP) ..... 9-289131

(51) Int. Cl.[7] ..... B24B 49/00

(52) U.S. Cl. ..... 451/9; 451/5; 451/10; 451/259

(58) Field of Search ..... 451/5, 9, 10, 259, 451/293, 375

(56) References Cited

U.S. PATENT DOCUMENTS 3,711,997 * 1/1973 Kushigian .
4,461,121 * 7/1984 Motzer et al. .
4,475,320 * 10/1984 Webster .
4,782,633 * 11/1988 Fuller, Jr. .
5,649,853 * 7/1997 Kuo .

* cited by examiner

*Primary Examiner*—Timothy V. Eley
*Assistant Examiner*—Willie Berry, Jr.
(74) *Attorney, Agent, or Firm*—William L. Chapin

(57) ABSTRACT

A method and apparatus for automatically re-pointing twist drill bits includes a drill support mechanism including means for rotatably and axially translatably holding the shank of a drill bit, and a fluted portion receiver for supporting the fluted front cutting portion of the drill bit. The apparatus also includes an optical sensor unit which views the tip and blade part of the drill bit with the drill support mechanism in an off-line position, i.e., rotated away from a grinding wheel station. Responsive to error correction servo command signals received from a comparison of the actual orientation of drill bit cutting lips with a desired pre-determined template position, rotary and linear actuators in the drill support mechanism rotate the drill bit to the proper angular orientation, and advance the bit axially to a pre-determined protrusion length. Also, command signals to the fluted portion receiver elevate the drill bit point to a pre-determined elevation, whereupon a linear actuator cylinder linked via a pivot pin to the drill support mechanism rotates the latter to thereby place the properly oriented drill bit in contact with grinding wheels of a sharpening unit. After each of the grinding wheels has sequentially contacted the cutting edges and point of the drill bit and resurfaces the contacted areas to a desired sharpness, the linear actuator cylinder is used to rotate the drill support mechanism to the off-line position, whereupon a shank retainer is pivoted vertically away from the drill bit shank, allowing the re-conditioned bit to be removed and replaced with another bit to be re-pointed.

29 Claims, 11 Drawing Sheets

AUTOMATIC DRILL BIT RE-POINTING APPARATUS AND METHOD

BACKGROUND OF THE INVENTION

A. Field of the Invention

The present invention relates to devices and methods for sharpening or re-pointing twist drill bits. More particularly, the invention relates to an apparatus for automatically re-pointing twist drill bits.

B. Description of Background Art

Printed wiring boards (PWB's) used to hold and electrically interconnect electronic circuit components are typically fabricated as laminated stacks of copper foil sheets alternating with insulating sheets made of fiberglass, the latter containing glass fibers solidified with a resin such as epoxy. The glass fibers are highly abrasive, and can quickly dull drill bits used to drill holes in the PWB for receiving component leads, or for forming passageways or vias through the PWB. A typical PWB has a thickness of about 0.062 inch, and has hundreds of holes drilled through it. Each contact with the upper surface of a PWlB to drill a hole is referred to as a "hit." Since PWB's are usually arranged in stacks of two to five boards for drilling, a corresponding number of holes are drilled for each hit. Because the abrasive nature of the PWB board materials dulls typical drill bits after about 3000–5000 holes are drilled, the drill bit must be removed from service and re-sharpened after about 1,500–2,000 hits.

In conventional drill bit grinding apparatuses used to sharpen or re-point twist drill bits, the drill bit must be held in a chuck. Consequently, the operator must manually perform operations such as inserting the drill into the chuck of a drill bit holder mechanism, tightening the chuck to grip the drill, positioning or aligning the drill in relation to the drill bit holding mechanism and to a rotary grinding stone, advancing the drill bit towards a grindstone, retracting the re-pointed drill bit from the grindstone and removing the re-pointed drill bit. Because of all of the aforementioned operations, an operator can usually operate only a single drill bit grinding apparatus at a time. Thus, even an experienced operator can typically re-point no more than about 800 to 1,000 drill bits over an eight-hour work shift Therefore, there has been a strong demand for an automated drill bit re-pointing apparatus that has a higher throughput rate than existing re-pointing apparatuses, and which may be operated by less than highly skilled personnel. Despite a widespread need for an improved drill bit re-pointing apparatus, various difficulties have prevented the development of such an apparatus. The present invention was conceived of to provide an improved, automatic drill bit re-pointing apparatus in which functions performed manually in prior art devices are largely automated.

OBJECTS OF THE INVENTION

An object of the present invention is to provide an automatic apparatus for sharpening or re-pointing twist drill bits.

Another object of the invention is to provide a drill bit re-pointing apparatus which includes means for automatically aligning a drill bit with respect to a grinding wheel.

Another object of the invention is to provide a drill bit re-pointing apparatus having a drill bit holder mechanism which facilitates attachment of the drill bit to the apparatus for grinding, and removal of the bit upon completion of grinding.

Another object of the invention is to provide a drill bit re-pointing apparatus having a drill bit holder which incorporates means for rotating the bit about its longitudinal axis to a desired phase angle to orient the fluted, front cutting portion of the bit to a desired disposition relative to a grinding wheel.

Another object of the invention is to provide a drill bit re-pointing apparatus having fluted portion support means translatable transversely or perpendicularly relative to the longitudinal axis of the bit, between a position contacting the fluted portion of drill bits of various diameters and a non-contacting position.

Another object of the invention is to provide a drill bit re-pointing apparatus having a drill bit holder mechanism which includes means for axially advancing a drill bit to position the point of the bit at a desired extension distance from the holder mechanism.

Another object of the invention is to provide a drill bit re-pointing apparatus which includes means for aligning the phase angle and longitudinal protrusion or extension of a drill bit tip relative to an optical alignment device at a first, load/unload station, rotating the drill bit holder mechanism to second, grinding station where drill bit grinding stones grind the properly phased and extended drill bit, and rotating the drill bit holder back to the first load/unload station to permit the re-pointed drill bit to be removed from the apparatus.

Another object of the invention is to provide a drill bit re-pointing apparatus which includes a drill bit holder which has a pivotable shank retainer which may be pivoted upwards to allow the shank of a drill bit to be placed on a pair of phase-controlling roller wheels, and which may be pivoted downwardly to retain the shank in rotatable contact with the roller wheels.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an apparatus for sharpening or re-pointing twist drill bits, in which functions required in the re-pointing process are largely automated.

An automatic drill bit re-pointing apparatus according to the present invention includes a drill bit holder mechanism having a rear, shank holder structure and a front, fluted holder structure which is actuable from a lowered, rear non-contacting position to a raised position contacting and supporting the fluted front portion of drill bits of various diameters. The drill bit holder mechanism includes a motor-driven shank retainer which is pivotable upwardly to a first position allowing placement of a drill bit in the apparatus, and removal of the bit after it has been re-pointed, and pivotable downwards to a second position bearirg against the shank of the drill bit to thereby secure the bit in the holder mechanism. The drill bit holder mechanism also includes a pair of laterally adjacent, "phase control" rollers which support the lower portion of a drill bit shank, the rollers being motor driven to permit rotating the bit about its longitudinal axis to a particular orientation or phase angle of the cutting lips of the fluted front cutting portion of the bit. A motor-driven lead screw in the drill bit holder mechanism pushes against the rear shank face of a drill bit in the holder mechanism to advance the drill bit axially with respect to the phase control rollers to a desired protrusion length or extension distance from the holder mechanism.

According to the present invention, the drill bit holder mechanism is pivotably mounted on a spindle rotatable by means of a connecting link coupled to a station position linear actuator cylinder from a first, load/unload station position to a second, grinding station position. At the load/unload station is located an optical alignment apparatus including an optical imaging unit that has an objective lens longitudinally aligned with and spaced outwards from the tip or point of a drill bit held in the drill bit holder mechanism. The optical imaging unit includes a CCD camera, on the focal plane of which is formed an image of the tip of the drill bit. The image is displayed on a monitor and also transmitted to an optical pattern recognition computer which outputs command signals to the phase control roller drive motor that rotates the bit to a desired phase angle or orientation suitable for contacting grinding wheels at a grinding station.

The optical alignment apparatus also includes an electro-optical drill bit point extension sensor located between the optical imaging apparatus and the drill bit holder mechanism. Output signals from the extension sensor drive the lead screw motor to advance the drill bit axially in the holder to a pre-determined longitudinal extension distance therefrom.

When the drill bit phase angle and extension have been automatically adjusted as described above, the station position actuator is energized to pivot the drill bit holder mechanism from the first, load/unload station position to the second, grinding station position at which is located a plurality of rotating grinding stones which sequentially sharpen various surfaces of the drill bit, including the chisel point and lips or cutting edges of the drill bit flutes. During the sharpening process, a controller device inputs command signals to the phase rotating rollers which rotate the bit at a predetermined rate from its initial position adjusted at the load/unload station. Upon completion of the sharpening process, the bit holder mechanism is pivotably rotated back to the first, loadlunload station. Then, the shank retainer motor is operated to pivot the shank retainer away from the re-pointed drill bit, allowing the latter to be removed and replaced with another bit to be re-pointed. By utilizing a robotic arm or similar device to load and unload drill bits from the apparatus, drill bits may be re-pointed completely automatically.

BRIEF DESCRIPTION OF THE DRAWINGS

FIG. 1(2) is a partly sectional side elevation view of the mechanism of FIG. 1(1).

DESCRIPTION OF THE PREFERRED EMBODIMENTS

FIGS. 1–15 illustrate various features of an automatic drill bit re-pointing apparatus according to the present invention.

Figure 2:
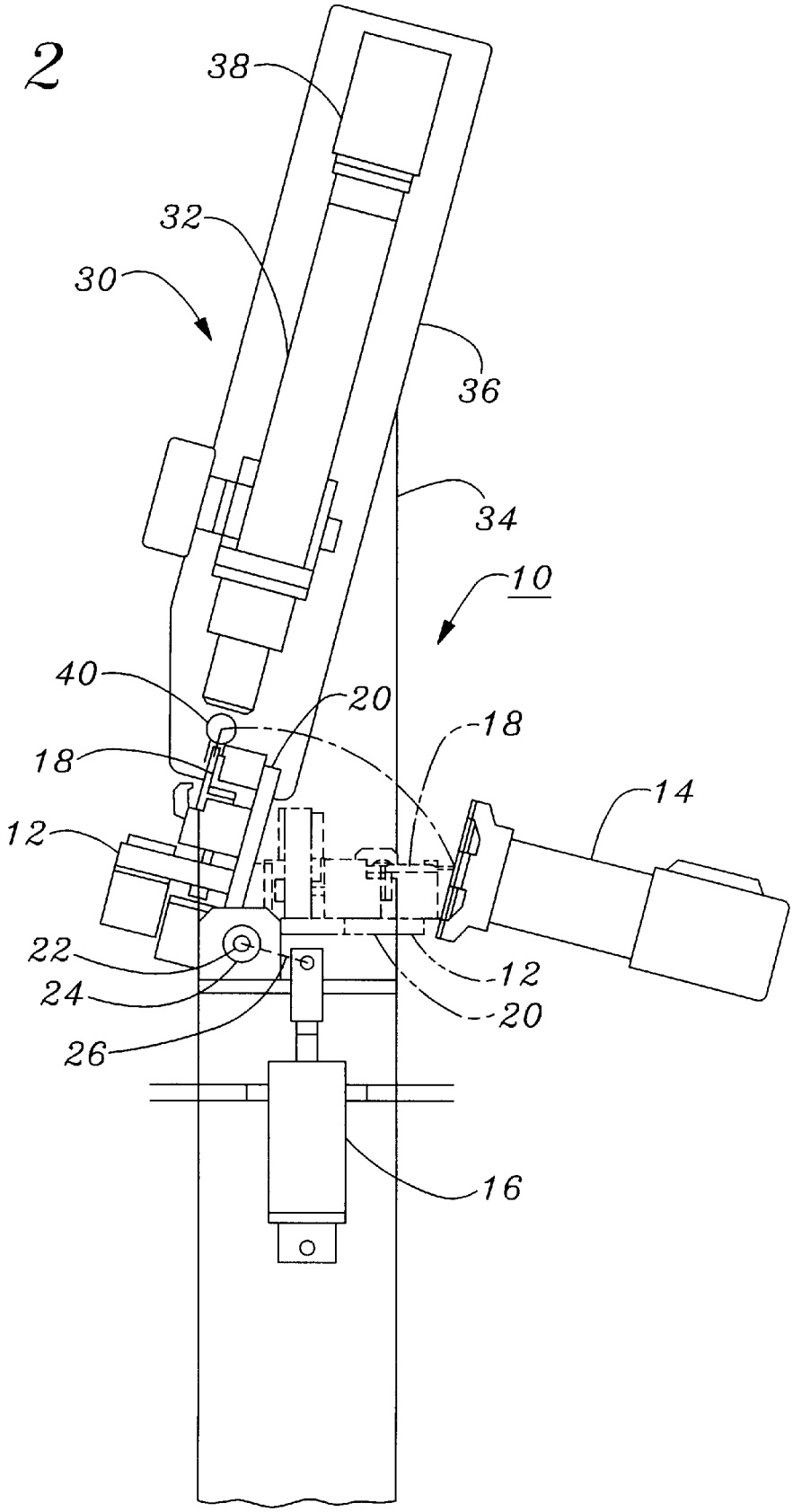
FIG. 2 is a side elevation view of an automatic drill bit re-pointing apparatus according to the present invention.
Figure 3:
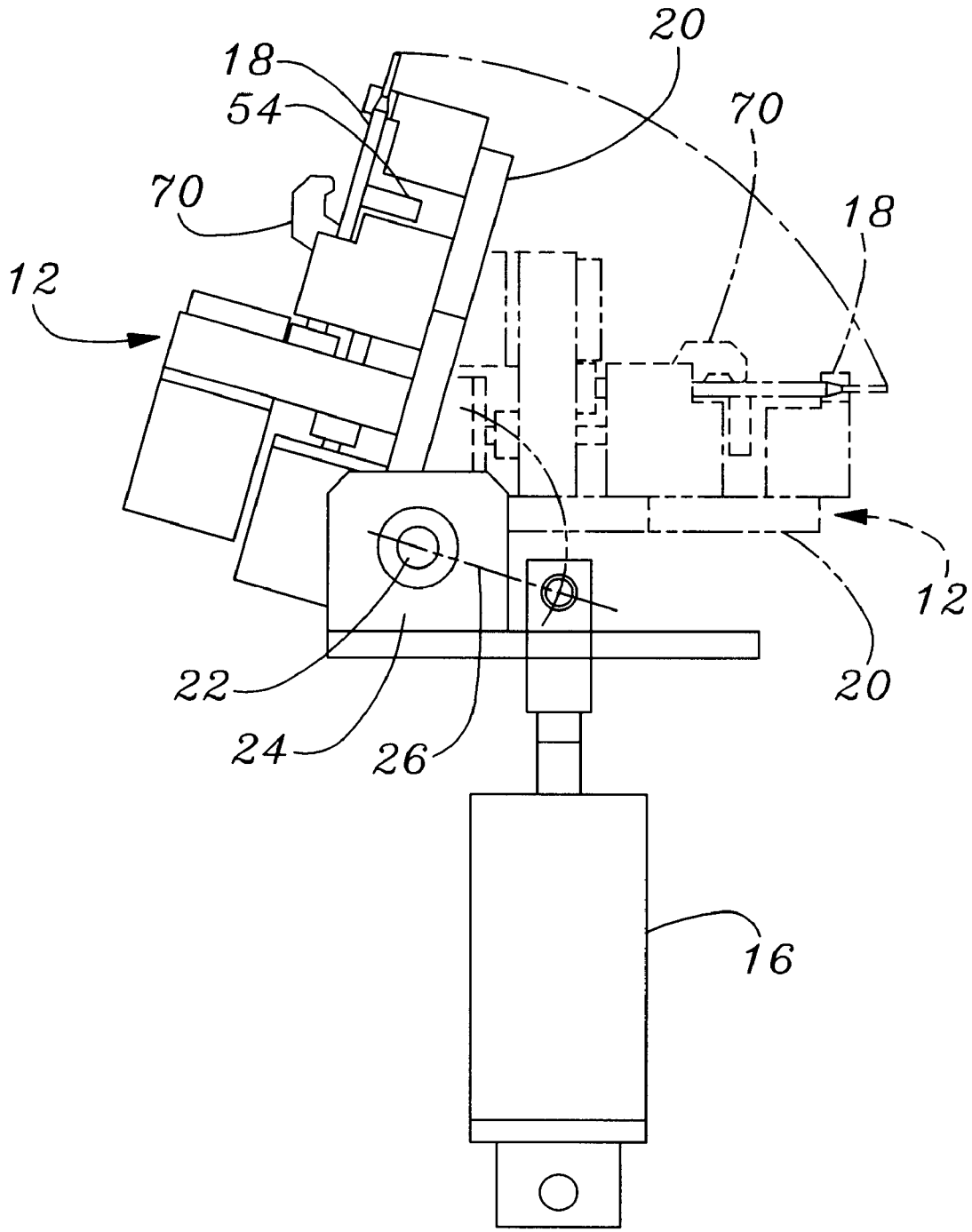
FIG. 3 is a fragmentary side elevation view of the apparatus of FIG. 2 on a somewhat enlarged scale, and showing the drill bit holder mechanism thereof pivoted from a first, load/unload/align station position indicated by solid lines, to a second, grinding station position indicated by phantom lines.

Referring first to FIG. 2, an automatic drill bit re-pointing apparatus 10 according to the present invention may be seen to include a support structure 34 to which is pivotably attached a drill bit holder mechanism 12. Automatic drill bit re-pointing apparatus 10 also includes an optical alignment apparatus 30 fastened to an optical bench 36, which is in turn fastened to support structure 34 of the apparatus. Optical alignment apparatus 30 includes a telescope 32 that images the point or tip of drill bit 18 on the focal plane of a CCD camera 38, for ascertaining the angular orientation or phase of the cutting edges or lips of a drill bit held in holder mechanism 12. Apparatus 30 also includes an optical tip position sensor 40 for ascertaining the protrusion distance longitudinal extension of the drill bit tip relative to drill bit holder mechanism 12.

As shown in sold lines in FIG. 2, drill bit holder mechanism 12 of automatic drill bit re-pointing apparatus 10 is located at a first, load/unload/align station position at which drill bits may be loaded or attached to the drill bit holder mechanism and aligned properly by means of optical alignment apparatus 30, in a manner to be described in detail below. Then, drill bit holder mechanism 12 is pivoted to a second, sharpening station location indicated by dashed lines, by a linear actuator 16 coupled by a coupling link 26 to a pivot pin or spindle 22. At the sharpening station, the drill bit is contacted by grinding wheels of a sharpening or grinding unit 14. Upon completion of the grinding or re-pointing process, drill bit holder mechanism 12 is pivoted back to the first, load/unload/align station by operation of linear actuator 16. Here the re-pointed drill bit may be removed and replaced by another bit to be re-pointed.

Figure 1:
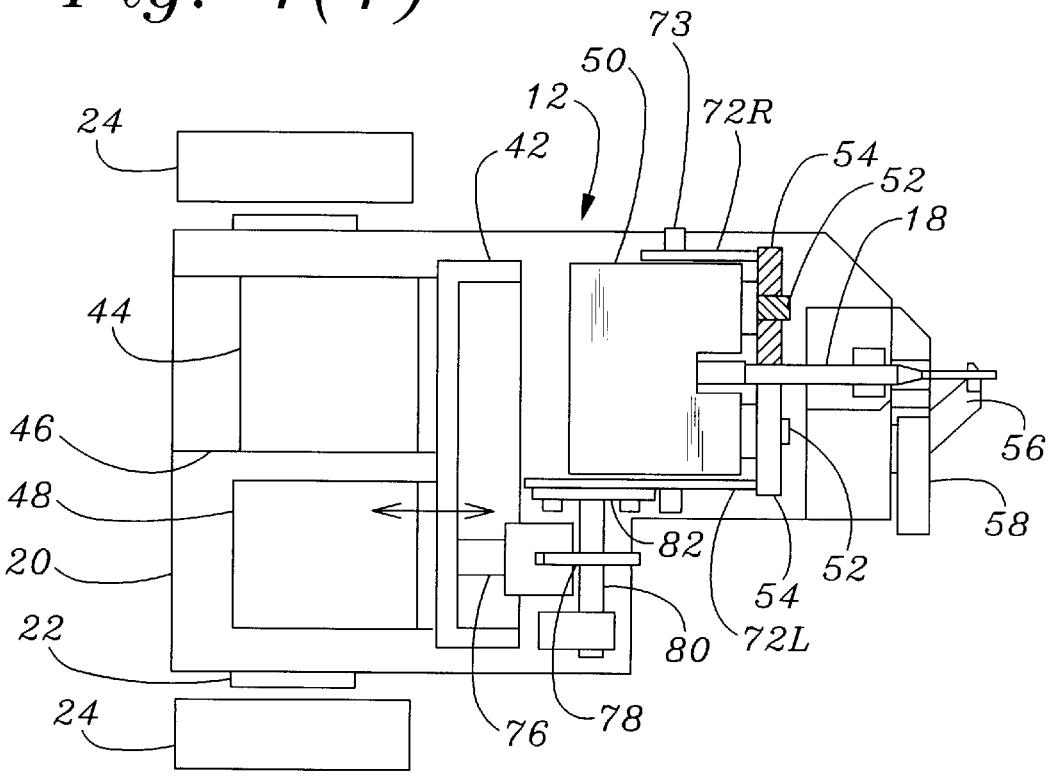
FIG. 1(1) is a partly sectional upper plan view of a drill bit holder mechanism comprising part of an automatic drill bit re-pointing method and apparatus according to the present invention.
Figure 1:
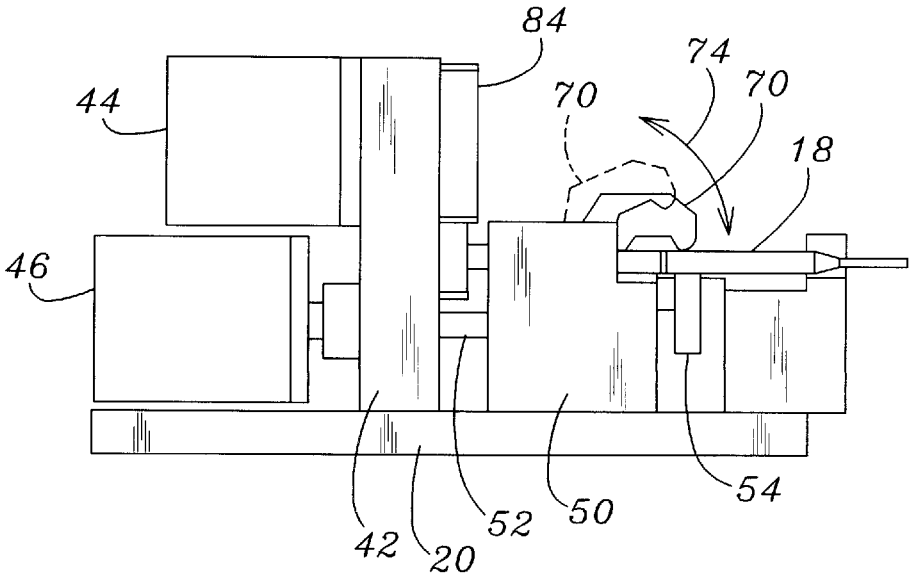

Referring now to FIGS. 1(1) and 1(2), it may be seen that drill bit holder mechanism 12 includes a generally flat, longitudinally elongated base plate 20. A pivot pin or spindle 22 disposed laterally near the rear edge wall of the plate is secured to the underside of the plate. As shown in FIG. 2, opposite lateral ends of spindle 22 are rotatably secured in a pair of opposed bushings 24 fastened to apparatus support structure 34.

Referring still to FIGS. 1(1) and 1(2), it may be seen that drill bit holder mechanism 12 of apparatus 10 includes a motor mounting plate 42 which protrudes perpendicularly upwards from base plate 20 of the mechanism. Attached to motor mounting plate 42 is a drill bit tip axial position controller motor 44 which powers a lead screw-type linear tip position actuator mechanism used to advance drill bit 18 in the direction of its longitudinal axis. Also attached to motor mounting plate 42 is a phase controller motor 46 which powers a rotary flute orientation actuator used to rotate drill bit 18 around its longitudinal axis. As shown in FIG. 1(1), drill bit holder mechanism 12 also includes a linear shank holder actuator cylinder 48 which is preferably a pneumatic cylinder, and has a piston rod 76 which is longitudinally slidably disposed through motor mounting plate 42. The remaining structural components and functions of the three aforementioned actuators are described in detail below.

Figure 6:
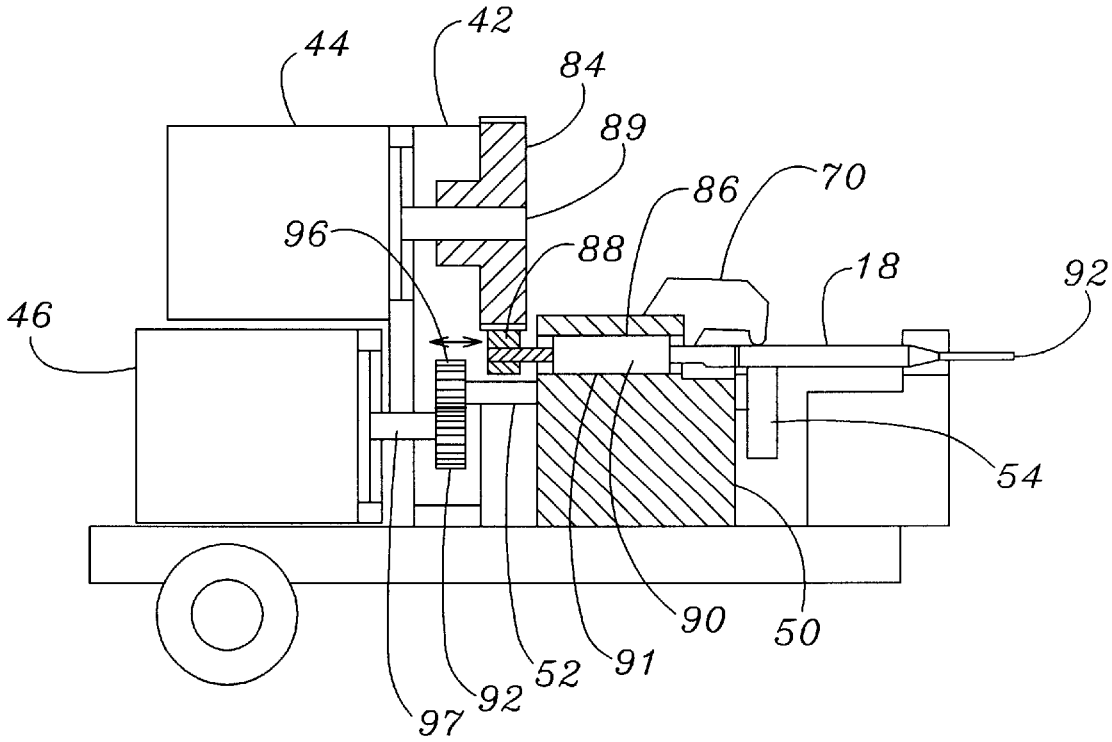
FIG. 6 is a partly sectional side elevation view of the mechanism of FIG. 1(1), but showing sections removed in addition to those removed in FIG. 1(2).
Figure 7:
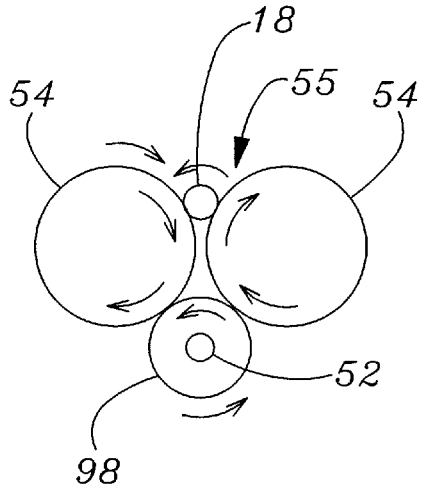
FIG. 7 is a fragmentary front sectional view of the mechanism of FIG. 1(1), showing details of the phase control device thereof.

Referring again to FIGS. 1(1) and 1(2), it may be seen that drill bit holder mechanism 12 includes a drill bit shank holder block 50 which protrudes perpendicularly upwards from upper surface 21 of base plate 20. Shank holder block 50 is located longitudinally forward of actuator motor mounting plate 20, and rearward of the front transverse edge wall of base plate 20. Referring to FIGS. 6 and 7 in addition to FIGS. 1(1) and 1(2), it may be seen that shank holder block 50 supports a pair of parallel, laterally spaced apart and aligned spindles 52 which are rotatably supported by bearing (not shown) within the block, and which protrude longitudinally forward from the front surface of the block. Near the front end of each rotatable spindle 52 is attached a circular disk-shaped roller 154 having an outer circumferential surface made of rubber. As may be seen best by referring to FIG. 7, the inner facing surface of rollers 54 are spaced very slightly apart from one another, thus forming an arcuately curved, generally V-shaped recess 55 between the upper portion of the rollers which may receive the shank of a drill bit 18. As shown in FIGS. 1 and 2, drill bit 18 is placed on rollers 54 with the shank of the bit protruding rearward towards shank holder block 50.

Figure 4:
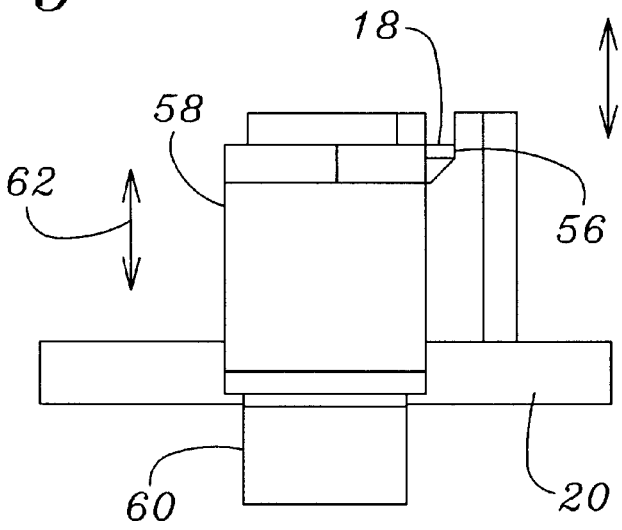
FIG. 4 is a fragmentary front elevation view of the drill bit holder mechanism of FIG. 1, showing details of a blade receiver portion of the mechanism used to support the front, fluted blade portion of a drill bit.

Referring now to FIG. 4 in addition to FIGS. 1 and 2, it may be seen that drill bit holder mechanism 12 includes a front fluted portion receiver 56 for supporting the front fluted portion of a drill bit 18. Fluted portion receiver 56 includes an arm 57 which protrudes obliquely upwardly from a support block 58, and has at the upper end thereof a fluted portion support flange 59 adapted to support the lower surface of the front, fluted cutting portion of a drill bit 18 held in holder mechanism 12. Support block 58 is attached to the upper end of a vertically disposed fluted portion receiver actuator 60, which is in turn fastened to support plate 20. By energizing actuator 60, fluted portion receiver 56 may be moved up and down, as indicated by arrows 62 in FIG. 4, to support the front fluted portion of drill bits of various diameters.

Figure 5:
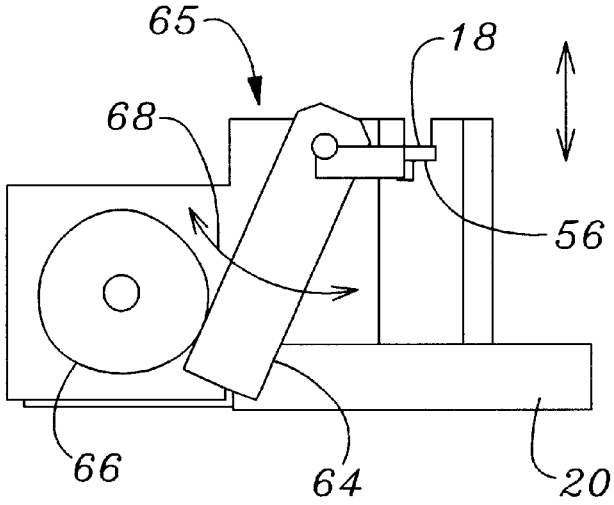
FIG. 5 is a view similar to that of FIG. 4, showing an alternate embodiment of a blade receiver.

FIG. 5 illustrates an alternate mechanism 65 for raising and lowering fluted portion receiver 56. Alternate mechanism 56 includes a pivot arm 64 which is attached at the upper end thereof to fluted portion receiver 56. A side of the lower end of pivot arm 64 bear's tangentially against the outer surface of a cam 66 driven by a motor (not shown). Thus, when the cam is driven by the motor, pivot arm 64 pivots in the direction indicated by arrows 68 in FIG. 5, raising or lowering fluted portion receiver 56.

Referring again to FIG. 1(2), it may be seen that drill bit holder mechanism 12 includes a finger-like shank retainer 70. As shown by arrows 74 in FIG. 1(2), shank retainer 70 may be pivoted in a vertical plane between an upper, non-contacting position allowing loading and unloading of a drill bit 18 into drill bit holder mechanism 12, and a lower position in which the "finger tip" of the shank retainer bears against the upper surface of the shank of a drill bit 18, thus pressing the shank against phase controller rollers 54, (see FIG. 1-(1)), and thereby securing the drill bit in the holder. Drill bit holder mechanism 12 includes components described below which cooperate with shank retainer actuator cylinder 48 to pivot shank retainer 70 between an upper, load/unload position to a lower, shank retaining position.

Thus, as shown in FIG. 1-(1), a piston rod 76 protrudes forward from actuator cylinder 48 through motor mounting plate 42, and is coupled at the front end thereof through a first crank arm-link structure 82 to an intermediate longitudinal location of an operating spindle or first pivot shaft 80, which is rotatably mounted about its longitudinal axis relative to drill bit shank retainer block 50. First pivot shaft 80 in turn is coupled at an inner longitudinal location thereof, nearer shank retainer block 50, by a second, inner crank arm-link structure 82 to a first, left side longitudinal support arm 72L for shank retainer finger 70. Pivot arm 72L and a counterpart support arm 72R are disposed parallel to left and right sides of shank retainer support block 50, respectively, and are fastened to opposite lateral ends of a second pivot rod 73 that is transversely disposed through the shank retainer block, and rotatably supported therein. Attached to the front ends of arms 72L, 72R is a transversely disposed cross arm 85. Shank retainer finger 70 is fastened to the center of cross arm 85. Therefore, when shank retainer actuator cylinder 48 is energized, coupling link structure 78 causes operating spindle 80 to rotate, rotational motion of which is transferred through coupling link structure 82 to the rear end of left longitudinal shank retainer support arm 72L. Downward pivotal motion of the rear end of shank retainer longitudinal support arm 72L causes the longitudinal support arm to pivot upwards about pivot rod axle 73, which in turn causes the front end of support arm 72L, cross arm 85 and shank retainer finger 70 to pivot upwardly away from the shank of drill bit 18. Conversely, actuation of linear actuator cylinder 48 in the opposite direction causes shank retainer finger 70 to pivot downwardly and bear against the shank of drill bit 18.

FIG. 6 illustrates the structure and function of components which cooperate with drill bit tip axial position controller motor 44 to extend the point of a drill bit 18 to a desired protrusion length or extension distance relative to fluted portion receiver 56. As shown in FIG. 6, axial tip position controller motor 44 has a shaft 89 which protrudes forward through actuator motor mounting plate 42, the shaft having a drive gear 84 pinned to the front end of the shaft. Drive gear 84 is a spur gear having longitudinally disposed teeth that slidably mesh with teeth of a driven gear 88 pinned to the rear end of a spindle 86. Spindle 86 has an enlarged diameter. longitudinally centrally located mid-section 90 which has a helically threaded outer surface. Threaded mid-section 90 of spindle 86 is threadingly engaged within an internally threaded bore 91 disposed longitudinally through drill bit shank holder block 50. Thus, when motor 44 turns drive gear 84, driven gear 88 threadingly advances or retracts mid-section 90 Of spindle 86 in threaded bore 91, depending upon whether motor shaft 89 rotates clockwise or counterclockwise. Since gears 84 and 88 are spur gears, relative longitudinal sliding movement between the gears may occur while torque is transmitted through the meshed gears to spindle 86.

As shown in FIG. 6, bore 91 through shank holder block 50 is coaxially aligned with a drill bit 18 supported on phase control rollers 54. When a drill bit 18 is initially loaded into drill bit holder mechanism 12, motor 44 is commanded to fully retract spindle 86 in bore 91, allowing the shank of the bit to be inserted some distance into bore 91 until the rear face of the shank abuts the front face of spindle 86. With this arrangement, motor 44 may be powered for a duration sufficient to advance spindle 86 and bit 18 axially forward until the point 132 of the bit protrudes a desired distance from fluted portion receiver 56.

FIG. 6 also illustrates components of holder mechanism 72 which cooperate with phase controller motor 46 to rotate a drill bit 18 about its longitudinal axis to a predetermined angular orientation of the cutting lips of the drill bit.

Thus, as shown in FIG. 6, phase controller motor 46 has a shaft 97 which protrudes forward through actuator motor mounting plate 42, the shaft having a drive gear 92 pinned to the front end of the shaft. Drive gear 92 is a spur gear having longitudinally disposed teeth that mesh with teeth of a driven gear 96 pinned to the rear end of an axle shaft 52. Axle shaft 52 is rotatably supported in drill bit shank holder block 50, and protrudes forward through the drill bit shank holder block, beyond the front wall surface thereof. As shown in FIG. 7, a driver roller 98 is pinned to the front end of axle shaft 52, and tangentially contacts a pair of adjacent phase control rollers 54. Thus, when axle shaft 52 and driver roller 98 are rotated in a clockwise direction by phase controller motor 46, contact of the driver roller with phase control rollers 54 causes the latter to rotate in the opposite, i.e., counterclockwise direction. Also, tangential contact between phase control rollers 54 and the shank of a drill bit 18 pressed downwardly into recess 55 between the rollers causes the shank to rotate in a direction opposite to that of the rollers, i.e., in a clockwise sense. Thus, drill bit 18 may be rotated in a clockwise or counterclockwise direction to a desired angular orientation by electrically powering phase controller motor 46 to rotate in a clockwise or counterclockwise direction.

Figure 8:
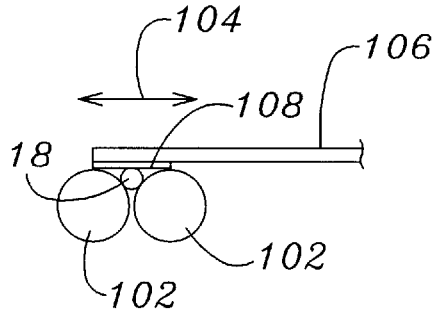
FIG. 8 is a view similar to that of FIG. 7, but showing a first variation of the phase control device thereof.

FIG. 8 illustrates a first variation of the phase control device depicted in FIG. 7 and described above. In this first variation, the shank of a drill bit 18 is pressed into contact with a pair of adjacent idler rollers 102 made of a metal or the like. The upper surface of drill bit shank 18 is pressed against by a friction pad 108 disposed laterally on the underside of a laterally disposed, phase adjusting drive arm 106 movable in a lateral direction by a linear actuator (not shown). When drive arm 106 is moved forward to the left or back to the right, as shown by the arrows 104; drill bit 18 is caused to rotate in a counterclockwise or clockwise sense, respectively.

Figure 9:
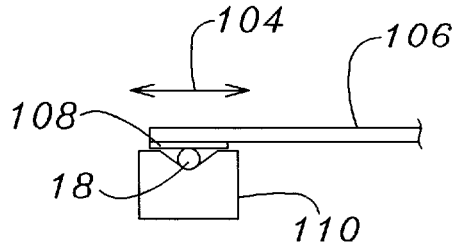
FIG. 9 is a view similar to that of FIG. 7, but showing a second variation of the phase control device thereof.

FIG. 9 illustrates a second variation of a phase control device, which is substantially similar in structure and function to the device depicted in FIG. 8 and described above. However, in the device depicted in FIG. 9, idler rollers 102 are replaced by a block 110 having in the upper surface thereof a V-shaped groove for rotatably receiving the shank of a drill bit 18.

Figure 10:
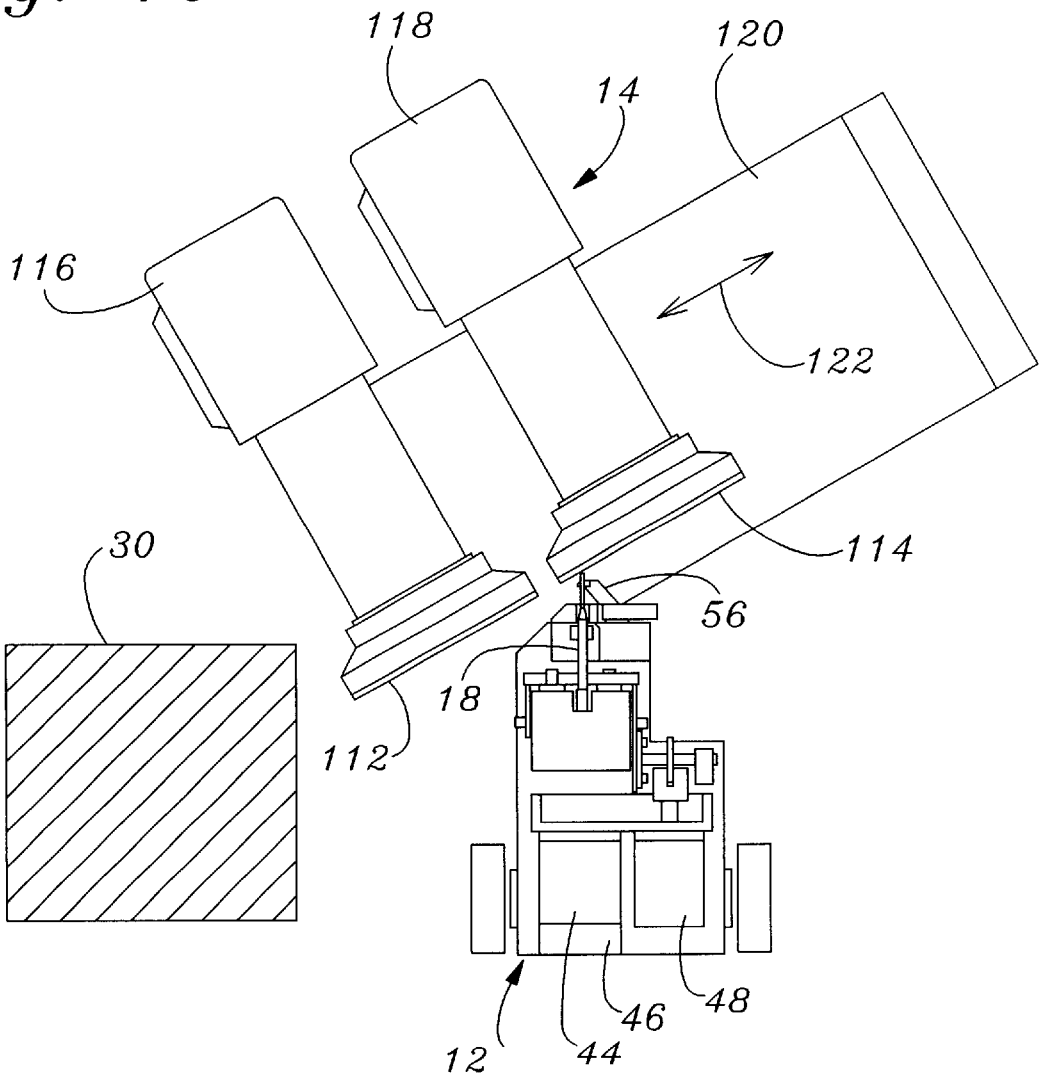
FIG. 10 is a fragmentary side elevation view of the apparatus of FIG. 2, showing the relative arrangement of an optical alignment apparatus and sharpening unit thereof.

FIG. 10 illustrates structural details of sharpening unit 14. As shown in FIG. 10, sharpening unit 14 has a primary rotating sharpening stone 112 which sharpens a first tip surface of a drill bit 18, and a secondary sharpening stone 114 which sharpens a second tip surface. Sharpening stones 112, 114 are installed on rotary drive motors 116, 118, respectively, the spin axes of which are inclined at different angles with respect to the longitudinal axis of a drill bit 18 to an orientation suitable for sharpening the first and second surfaces of the drill bit tip. In addition, sharpening stones 112, 114 are arranged on a table 120 which is made to tilt against the drill bit 18, with a traversing structure (not shown) which moves sharpening stone driver motors 1 16, 11 8, with respect to the table 120, as shown by arrows 122.

Figure 12:
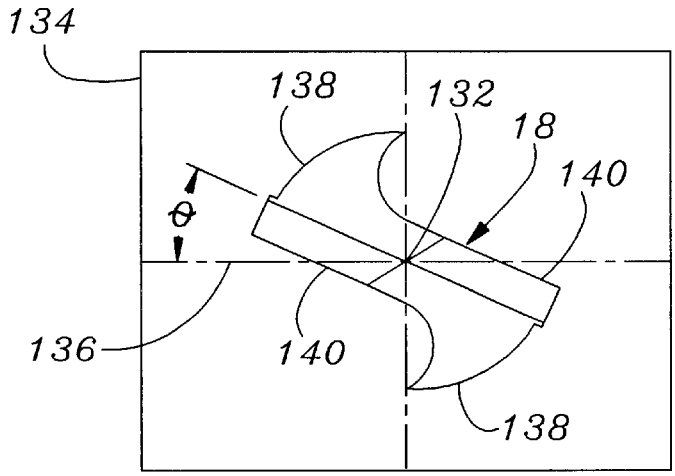
FIG. 12 is a front elevation of a drill bit tip as viewed on a monitor connected to the optical alignment apparatus of FIGS. 2 and 11.
Figure 11:
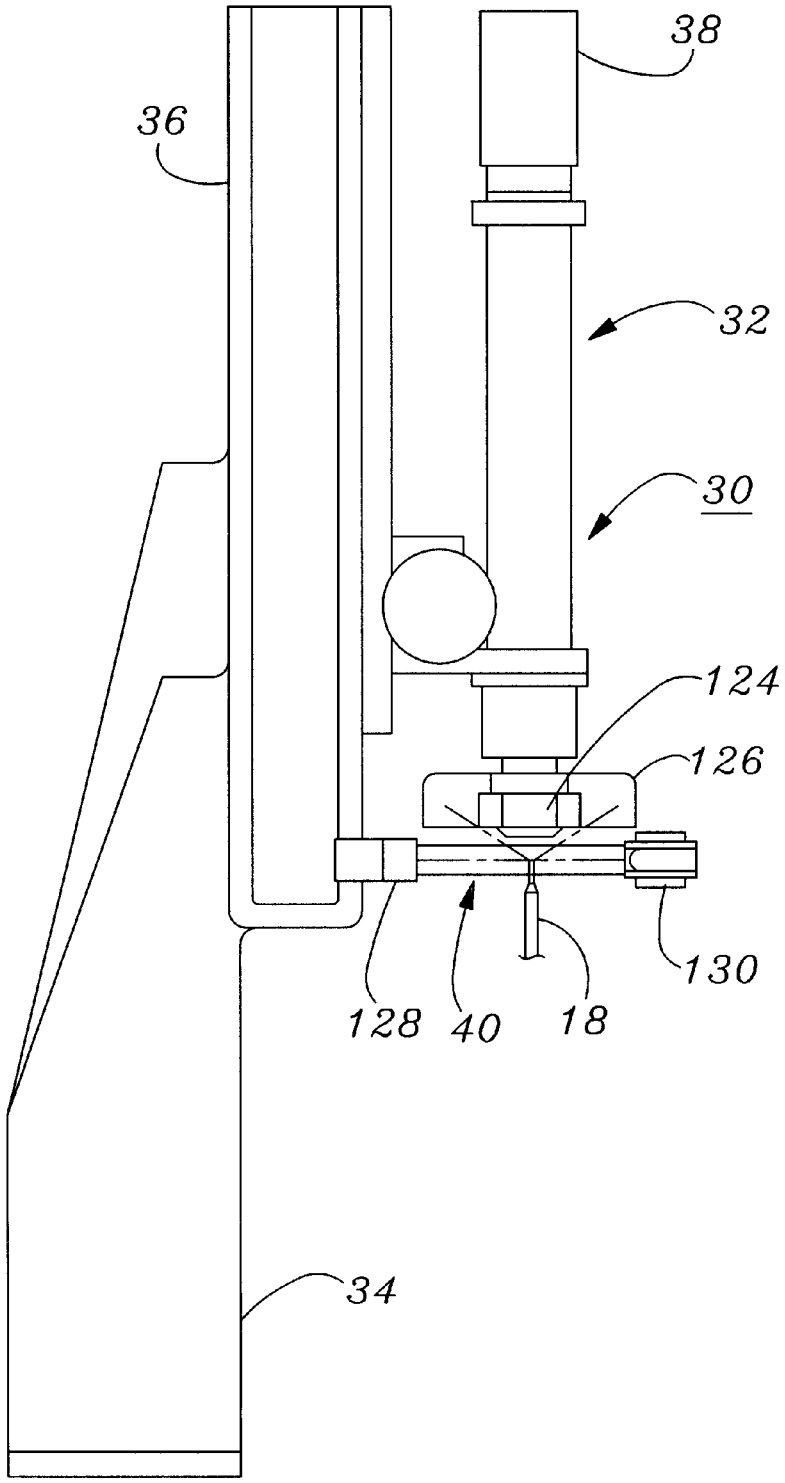
FIG. 11 is a front elevation view of the optical alignment apparatus portion of the re-pointing apparatus shown in FIG. 2.

The structure and function of optical alignment apparatus 30 of drill bit re-pointing apparatus 10, may be best understood by referring to FIGS. 2, 11 and 12.

As shown in FIG. 11, optical imaging unit 31 of optical alignment apparatus 30 includes an annular light source 126 which fits coaxially over the objective lens tube 124 of a telescope tube 32. An annular pattern of light rays directed forward from light source 126 is effective in illuminating tip of drill bit 18.

Tip position sensor 40 of apparatus 30 includes a photo detector 128 which protrudes radially outwards from optical bench 36, near the front end of the optical bench. Photo detector 128 is axially offset inwardly from the optical axis of telescope tube 32, and transversely aligned with a plane spaced forward of objective lens 124. Optical tip position sensor 40 also includes a light source 130 transversely aligned with photo detector 128, and radially offset outwardly from the optical axis of telescope tube 32. Light source 130 illuminates sensor 128 with a transversely disposed beam of light. Photo detector 128 outputs a detection signal indicative of the axial extension distance of the point of a drill bit 18 relative to sensor 40, the detection signal being used to command axial position motor 44 to advance drill bit 18 to a pre-determined extension position forward of fluted portion receiver 56.

Operation of automatic drill bit re-pointing apparatus 10 is as follows:

First, as shown in FIG. 2, a drill bit 18 to be re-pointed is loaded into drill bit holding apparatus 12, with the holding apparatus located at the load/unload/alignment station position shown at the left-hand side of FIG. 2. Drill bit 18 is loaded by placing the shank of the bit onto phase controller rollers 54, and pushing the bit rearward into bore 91 of drill bit shank holder block 55 sufficiently far for the rear face of the drill bit shank to contact the front face of axial position controller spindle 86, which has been retracted in bore 91 by an initialization command signal issued to axial drive motor 44 from an electronic controller, such as a computer (not shown). Drill bit 18 is loaded into holder apparatus 12 by any convenient means, such as by hand, or preferably by an automatic handling apparatus such as a robotic arm. As shown in FIGS. 1-(1) and 1-(2), drill bit 18 is positioned in holder apparatus 12 with the front, fluted portion of the bit supported on fluted portion receiver 56. After drill bit 18 has been thus positioned in drill bit holder apparatus 12, shank retainer actuator cylinder 48 is energized, causing shank retainer finger 70 to pivot downwardly against the upper surface of the shank of drill bit 18, pressing the lower surface of the shank into secure contact with phase controller rollers 54, as shown in FIG. 1-(2).

With a drill bit 18 installed in drill bit holder apparatus 12 in the manner described above, the control computer issues a command signal which causes axial position drive motor 44 to rotate, causing lead screw spindle 86 to advance in bore 91 of shank holder support block 50. Spindle 86 pushes drill bit 18 axially forward until point 132 of the bit extends to within a predetermined distance forward of objective lens 124 of optical alignment sensor 30. At the predetermined position, axial point position sensor photo detector 128 produces a detection signal which commands cessation of drive current to drive motor 44, thus maintaining the point of drill bit 18 at the predetermined axial extension.

When point 132 of drill bit 18 has been positioned at a desired axial extension beyond fluted portion receiver 56, as determined by point position sensor 40, telescope 32 of optical imaging unit 31 forms an image of the front fluted portion of drill bit 18 on the focal plane of CCD camera 38, as shown in FIG. 12. If the center of drill bit chisel point 132 is not at a pre-determined, centered position in the field of view of telescope 32, such as the intersection of the horizontal and vertical cross hairs shown in monitor image 34 of FIG. 12, pattern recognition logic within the computer controller issues a command signal to fluted portion receiver actuator 60 to raise fluted portion receiver 56, thus elevating chisel tip 132 to the pre-determined alignment position. Since, in the preferred embodiment, phase control rollers 54, of bore 91, and shank retainer finger 70 are arranged so that the front end of drill bit 18 tilts downward slightly, as viewed in FIG. 1 -(1), it is only necessary to elevate fluted portion receiver 56 to vertically align drill bit chisel point 132 in the monitor image 134.

With chisel point 132 of drill bit 18 centered at a pre-determined position in monitor image 134, as described above, pattern recognition logic within the computer controller determines whether the lips or cutting edges 140 of the drill bit are oriented at a predetermined phase angle θ (theta) with respect to the horizontal center line of the image. If the measured phase angle differs from the pre-determined value, the computer controller issues a command signal to phase controller motor 46 to rotate drill bit 18 to the pre-determined phase angle.

After drill bit 18 has been precisely aligned relative to drill bit holder mechanism 12 using optical alignment apparatus 30, as described above, the computer controller issues a command signal to station position actuator cylinder 16. This action causes drill bit holder mechanism 12 to pivot downwardly from the first, load/unload/align station position shown in FIG. 2, to a horizontal disposition in which drill bit 18 is presented to sharpening station 14. Then, the computer controller issues command signals which cause first and second rotating grinding stone motors 116 and 118 to be moved by the traversing structure to translate the grinding stone motors in a pre-determined pattern, with first and second grinding stones sequentially contacting drill bit 18. During this operation, the computer controller issues drive signals to phase controller motor 46 which rotate drill bit 18 during the sharpening process.

After completion of the sharpening process, the computer controller issues a command signal to station position actuator 16 which causes drill bit holder mechanism 12 to pivot upwardly from the sharpening station position adjacent sharpening unit 14 to the load/unload/align station position adjacent optical alignment apparatus 30. Here an image of sharpened drill bit 18 is formed on the focal plane of CCD camera 38. The image is conveyed to the computer controller, wherein pattern recognition logic determines whether the shape of the sharpened drill bit falls within pre-determined acceptance parameters, in which case a PASS status signal is issued, or if outside the limits, a FAIL status signal is issued. After the PASS/FAIL test determination, the computer controller causes a command signal to issue to shank retainer actuator cylinder 48 which causes shank retainer finger 70 to pivot upwardly to an unload position, thus allowing the re-pointed drill bit to be removed and replaced with another bit to be re-pointed.

As explained above, the design of the drill bit holder mechanism of the automatic drill bit re-pointing apparatus according to the present invention facilitates loading and unloading drill bits from the apparatus. In addition, because the holder includes a lead screw mechanism for axially moving the drill bit to a pre-determined axial position, a cutting portion receiver actuator for transversely moving the drill bit point to a pre-determined height, and a phase controller mechanism for rotating the bit to a pre-determined initial phase angle of the cutting lips of the drill bit, and rotating the bit from the initial phase angle during grinding, sharpening of drill bits can be performed fully automatically with the apparatus according to the present invention.

Figure 13:
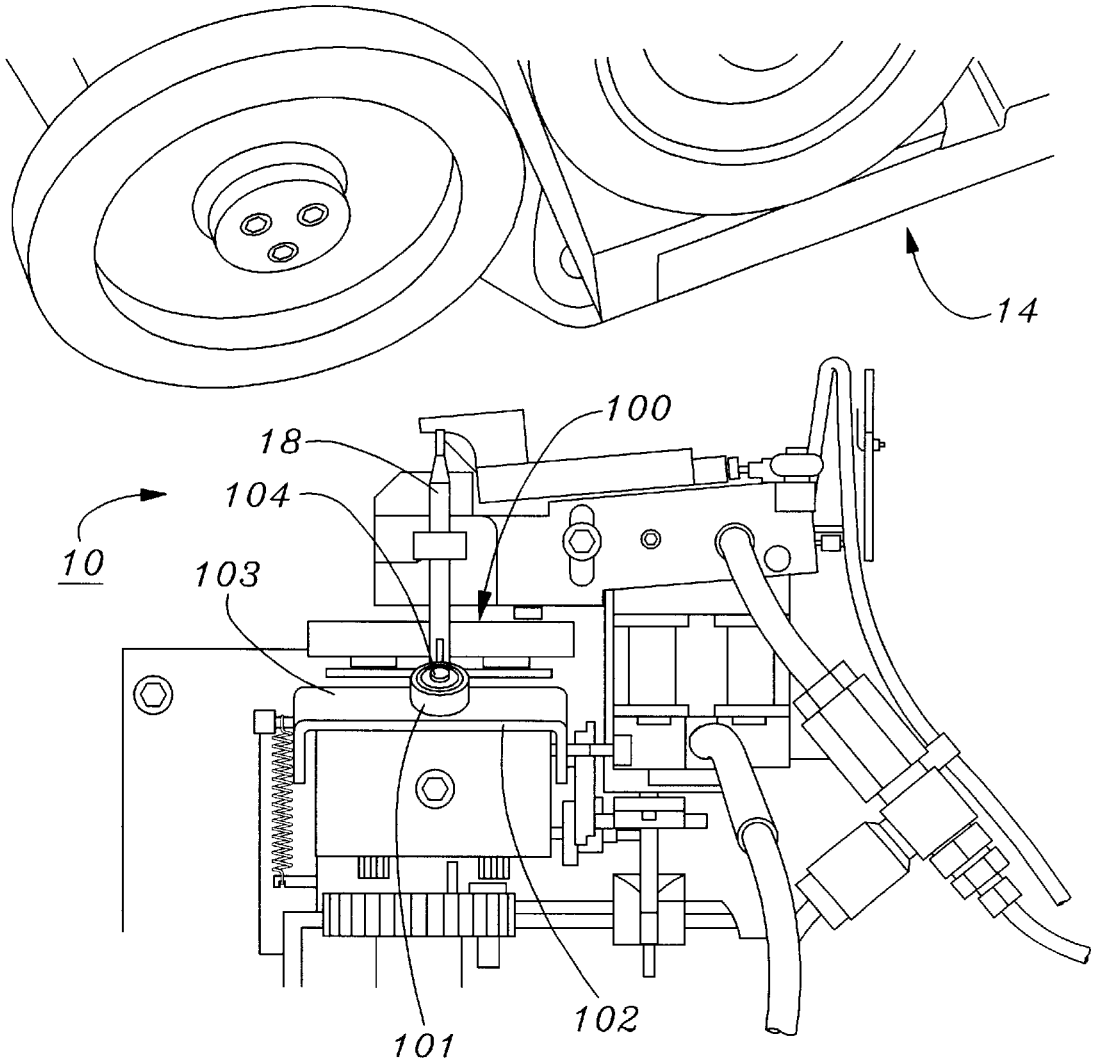
FIG. 13 is a fragmentary upper plan view of a modification of the apparatus of FIG. 1, showing a modified shank retainer thereof pivoted upwards to permit a drill bit to be loaded or unloaded from the apparatus.
Figure 14:
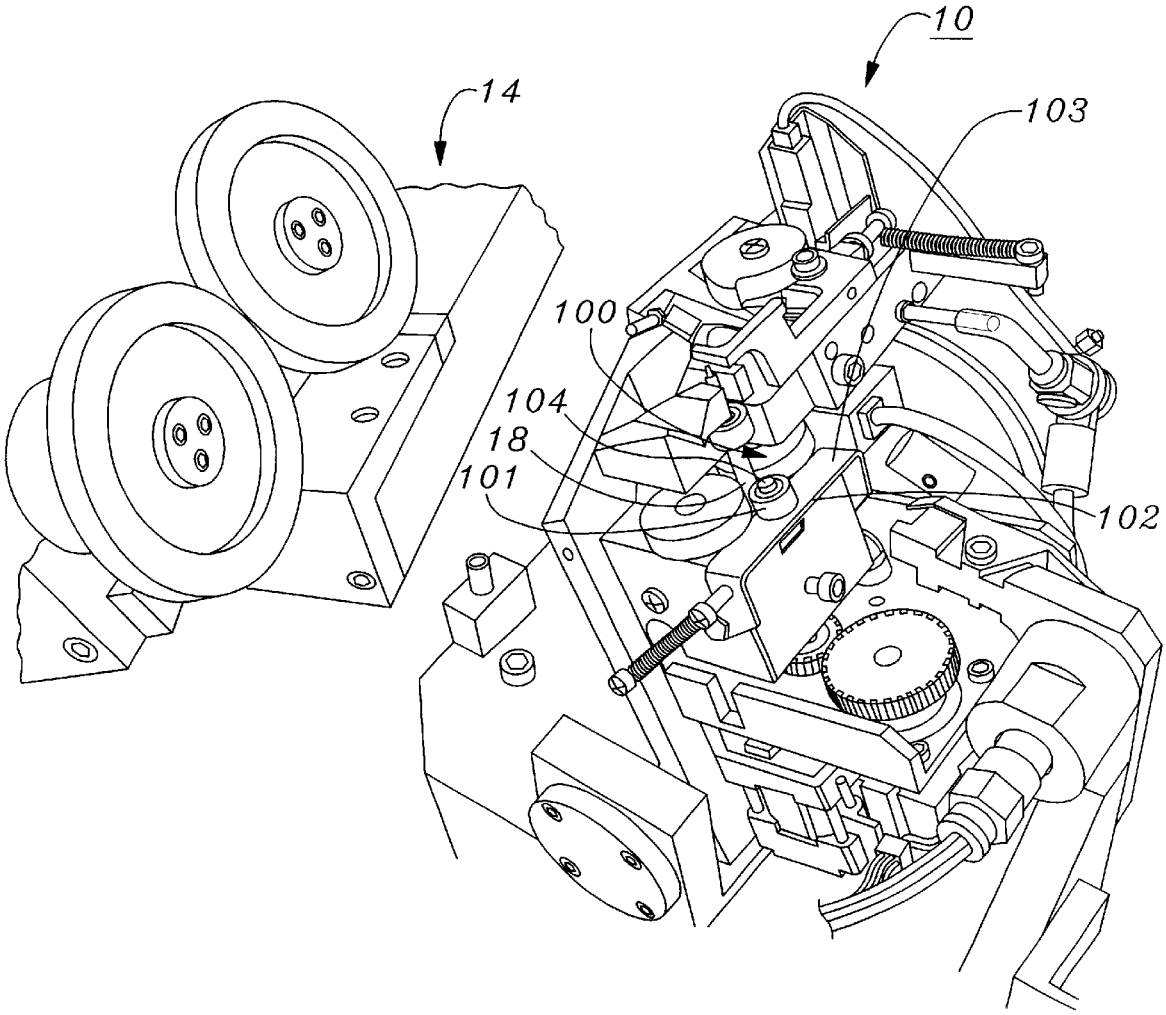
FIG. 14 is an oblique view of the structure of FIG. 13.
Figure 15:
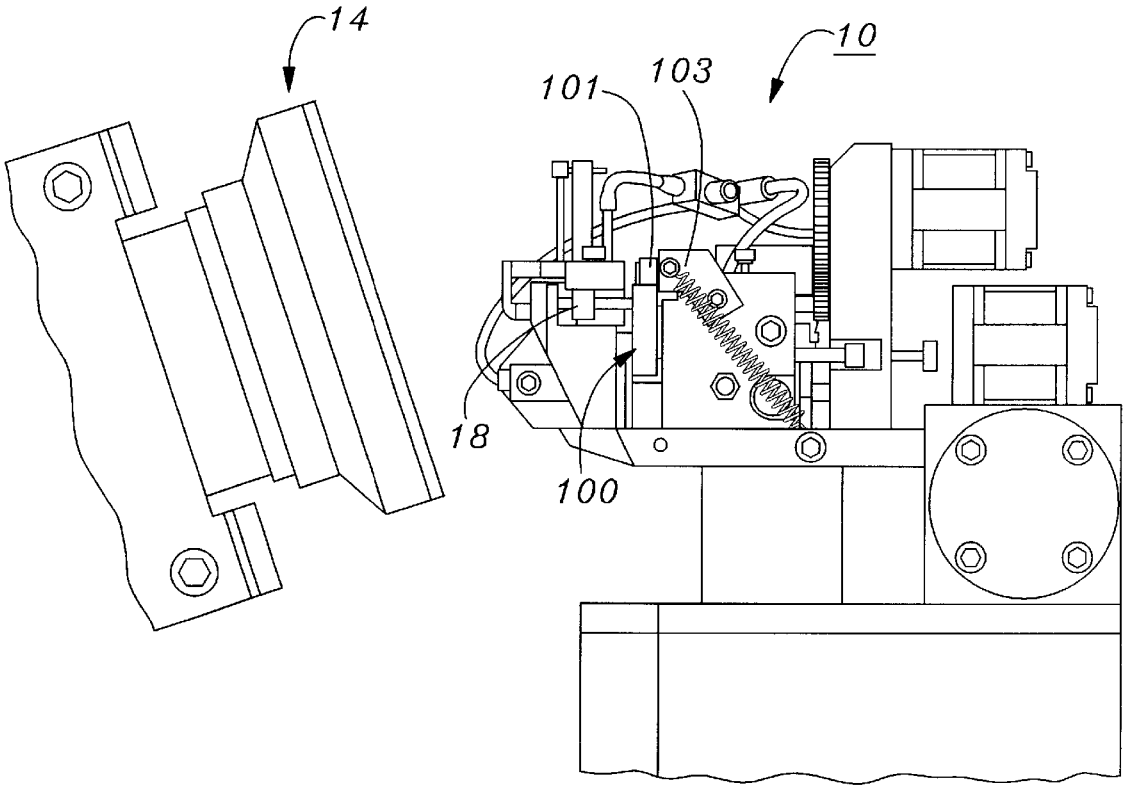
FIG. 15 is a side elevation view of the structure of FIG. 14

FIGS. 13–15 illustrate a preferred modification of the apparatus of FIGS. 1-(1) and 1-(2), which include a modification of the shank retainer 70 shown therein and described above.

As shown in FIGS. 13–15, modified shank retainer 100, rather than having a finger-like shape as depicted in FIG. 1-(2), comprises a cylindrically-shaped bushing 101 which protrudes from the front wall 103 surface of a plate-like cross arm 102. Bushing 101 is rotatably supported by an internal roller bearing assembly 104 which is fastened to front surface 103 of cross arm 102. With cross arm 102 pivoted downwardly as shown in FIGS. 14 and 15, bushing 101 tangentially contacts the shank of a drill bit 18. With this arrangement, modified shank retainer 100 may exert a substantial normal force against the shank of drill bit 18, while still allowing phase control rollers 54 to readily rotate the drill bit about its longitudinal axis.

What is claimed is:

1. An apparatus for sharpening twist drill bits comprises, a. a drill bit holder mechanism including, i. a front fluted portion holder structure adapted to support the fluted front portion of a drill bit, said structure including height adjustment actuator means effective in pivoting said drill bit to thereby position its tip at a pre-determined height, ii. a rear, shank holder structure adapted to support the shank of said drill bit, said structure including phase angle actuator means for rotating said drill bit about its longitudinal axis to a particular orientation or phase angle of the cutting edges or lips of said fluted front portion of said drill bit relative to said structure, b. an optical alignment apparatus located at a first, load/unload/align station position relative to said drill bit holder mechanism, said optical alignment apparatus adapted to measure the spatial position of said tip of said drill bit relative to said first station position, and c. station actuator means for moving said drill bit holder mechanism from said first station to a second, grinding station.

2. The apparatus of claim 1 further including controller means responsive to signals from said optical alignment apparatus in providing command signals to said phase actuator means effective in rotating said drill bit to a pre-determined phase angle.

3. The apparatus of claim 1 further including controller means responsive to signals from said optical alignment apparatus in providing command signals input to said height adjustment actuator means effective in moving said tip of said drill bit to a pre-determined height.

4. The apparatus of claim 1 further including controller means responsive to signals from said optical alignment appaatus in providing command signals input to said translational actuator means effective in moving said drill bit holder mechanism between said first station and said second station.

5. The apparatus of claim 1 wherein said rear shank holder structure is further defined as including a shank retainer pivotable between a first, unlocked position allowing placement of a drill bit in said holder structure, and a second, locking position bearing against said shank of said drill bit to thereby secure said bit in said holder structure.

6. The apparatus of claim 5 further including a retainer actuator effective in pivoting said retainer between said unlocked position and said locking position.

7. The apparatus of claim 1 wherein said optical alignment apparatus is further defined as including an optical imaging unit having a photo detector array and means for forming an image of the tip of said drill bit on said array, said photo detector array providing an output signal representative of the spatial orientation of said drill bit tip relative to said alignment apparatus.

8. The apparatus of claim 1 wherein said rear shank holder structure is further definied as including a longitudinal extension actuator for advancing said drill bit axially with respect to said structure.

9. The apparatus of claim 8 wherein said optical alignment apparatus is further defined as including a drill bit point extension sensor for determining the longitudinal extension of said drill bit tip relative to said shank holder structure and said optical alignment apparatus.

10. The apparatus of claim 1 wherein said phase angle actuator means for rotating said drill bit is further defined as comprising in combination adjacent roller means for rollably supporting a first longitudinal surface of said drill bit shank, shank retainer means for pressing against a second longitudinal surface of said drill bit shank opposite said first surface, and drive means for rotating said drill bit shank.

11. The apparatus of claim 10 wherein said drive means for rotating said drill bit shank is further defined as being a rotary actuator for rotatably driving at least one of said rollers.

12. The apparatus of claim 10 wherein said drive means for rotating said drill bit shank is further defined as a linear actuator frictionally contacting a surface of said drill bit shank, said linear actuator having a line of action transverse to the longitudinal axis of said drill bit shank.

13. An apparatus for sharpening twist drill bits comprising;

a. a drill bit holder mechanism including;

(i) a front fluted portion holder structure adapted to support the fluted front portion of a drill bit, said structure including height adjustment actuator means effective in elevating the tip of said drill bit to a pre-determined height, (Ii) a rear, shank holder structure adapted to support the shank of said drill bit, said structure including a pair of adjacent phase angle rollers for supporting a lower longitudinal surface of said drill bit shank, a shank holder block having a bore axially aligned with said drill bit shank supported on said phase rollers and adapted to insertably receive the rear end of said shank, and a shank holder retainer pivotable between a first, upper position and a second, lower position bearing against an upper longitudinal surface of said drill bit shank, (Iii) a spindle longitudinally retractable within said bore to receive said drill bit shank, and longitudinally extendable to push said drill bit shank axially forward a pre-determined distance, (Iv) phase angle actuator means for rotating said drill bit about its longitudinal axis to a pre-determined angular orientation of cutting lips of said drill bit to a pre-determined phase angle, (v) tip axial position actuator means for retracting and advancing said spindle, for advancing the tip of said drill bit to a pre-determined axial protrusion distance forward of said shank holder block, (vi) shank retainer actuator means for pivoting said shank retainer between said upper and lower positions, b. an optical alignment apparatus located at a first, load/unload/align station position relative to said drill bit holder mechanism, said optical alignment apparatus adapted to produce sensor signals signifying the spatial orientation of said drill bit tip relative to said shank holder block and said optical alignment apparatus, c. station actuator means for moving said drill bit holder mechanism from said first station to a second, grinding station, and d. controller means responsive to signals from said optical alignment apparatus in providing command signals input to said station actuator means effective in moving said drill bit holder mechanism between said first and second stations.

14. The apparatus of claim 13 wherein said controller means is further defined as being responsive to signals from said optical alignment apparatus in providing command signals input to said height adjustment actuator means effective in elevating the tip of said drill bit to a pre-determined height.

15. The apparatus of claim 13 wherein said controller means is further defined as being responsive to signals from said optical alignment apparatus in providing command signals input to said axial tip position actuator effective in advancing said drill bit tip to a pre-determined axial position forward of said shank holder block.

16. The apparatus of claim 13 wherein said controller means is further defined as being responsive to signals from said optical alignment apparatus in providing command signals to said phase angle actuator means for rotating said drill bit about its longitudinal axis to a pre-determined angular orientation of cutting lips of said drill bit.

17. The apparatus of claim 13 wherein said optical alignment apparatus is further defined as including a photo detector array and means for forming an image of the tip of said drill bit on said array.

18. The apparatus of claim 17 wherein said controller means is further defined as including pattern recognition logic effective in processing signals from said photo detector array to confirm that said drill bit tip is at a pre-determined spatial orientation relative to said optical alignment apparatus.

19. The apparatus of claim 18 wherein said pattern recognition logic is further defined as including a capability for determining whether the shape and dimensions of said drill bit tip meet acceptance criteria.

20. The apparatus of claim 13 wherein said optical alignment apparatus is further defined as including a drill bit point extension sensor for monitoring the axial protrusion distance of said drill bit point forward of said shank holder.

21. The apparatus of claim 20 wherein said drill bit point extension sensor is further defined as comprising in combination an illumination source and a photo detector located on opposite transverse sides of said drill bit.

22. The apparatus of claim 13 wherein said shank holder retainer is further defined as comprising in combination a pivot assembly including a longitudinally disposed support arm and a front pivot cross arm disposed transversely to and above said drill bit shank, said cross arm having protruding from the front surface thereof a drill bit shank contactable member.

23. The apparatus of claim 22 wherein said drill bit shank contactable member is further defined as being a bushing rollably supported with respect to said cross arm.

24. The apparatus of claim 22 wherein said shank retainer actuator means is further defined as being a linear actuator coupled to said pivot assembly support arm.

25. The apparatus of claim 13 wherein said shank pusher spindle is further defined as being threadingly engaged within said bore within said shank holder block.

26. The apparatus of claim 25 wherein said tip axial position actuator means is further defined as being a rotary motor having an output shaft rotatably coupled to said spindle.

27. The apparatus of claim 13 wherein said phase angle actuator means is further defined as being a rotary motor having an output shaft rotatably coupled to at least one of said phase angle rollers.

28. A method for pointing twist drill bits comprising;

a. loading a drill bit into a drill bit holder mechanism at a first, load/unload align station position, b. forming an image field including an image of the tip of said drill bit, c. advancing said drill bit axially to a pre-determined longitudinally extended position within said image field, d. elevating said tip of said drill bit to a pre-determined height within said image field, e. rotating said drill bit about its longitudinal axis to a pre-determined angular orientation of cutting lips of said drill bit within said image field, f. pivoting said drill bit holder mechanism to a second, grinding station, g. translating rotating grinding stones at said grinding station into contact with surfaces of said drill bit to thereby point said tip, h. pivoting said drill bit holder mechanism back to said first station, i. forming an image of said pointed tip to determine whether it meets acceptance criteria, and j. unloading said pointed drill bit from said drill bit holder mechanism.

29. The method of claim 28 wherein said elevating of said drill bit tip is further defined as being accomplished by pivoting said drill bit.

* * * * *